US006014992A

United States Patent [19]

Speich

[11] Patent Number: 6,014,992

[45] Date of Patent: Jan. 18, 2000

[54] MECHANICAL LOOM WITH PNEUMATIC WEFT THREAD INSERTION WITH SYNCHRONIZED CLAMP CUTTER AND REED

[75] Inventor: Francisco Speich, Gipf-Oberfrick, Switzerland

[73] Assignee: Textilma AG, Hergiswil, Switzerland

[21] Appl. No.: 09/051,568

[22] PCT Filed: Oct. 10, 1995

[86] PCT No.: PCT/CH95/00230

§ 371 Date: Apr. 7, 1998

§ 102(e) Date: Apr. 7, 1998

[87] PCT Pub. No.: WO97/13901

PCT Pub. Date: Apr. 17, 1997

[51] Int. Cl.[7] ..... D03D 47/30; D03D 47/34; D03D 47/38

[52] U.S. Cl. ..... 139/435.1; 139/192; 139/194

[58] Field of Search ..... 139/194, 435.1, 139/453, 192

[56] References Cited

U.S. PATENT DOCUMENTS

| | | | |
|---|---|---|---|
| 3,926,224 | 12/1975 | Vermeulen et al. | 139/435.1 |
| 4,572,246 | 2/1986 | Ghiaro | 139/435.1 |
| 4,834,145 | 5/1989 | Lewylie et al. | 139/194 |
| 4,967,807 | 11/1990 | Lewyllie et al. | 139/452 |
| 4,993,459 | 2/1991 | Shaw et al. | 139/452 |
| 5,649,570 | 7/1997 | Wahhoud et al. | 139/192 |

FOREIGN PATENT DOCUMENTS

| | | |
|---|---|---|
| 0120429 | 10/1984 | European Pat. Off. . |
| 0160117 | 11/1985 | European Pat. Off. . |
| 0318802 | 6/1989 | European Pat. Off. . |
| 0284766 | 10/1998 | European Pat. Off. . |
| 3204007 | 8/1983 | Germany . |
| 390826 | 8/1965 | Switzerland . |
| 2047286 | 11/1980 | United Kingdom . |

*Primary Examiner*—Andy Falik
*Attorney, Agent, or Firm*—Brown & Wood, LLP

[57] ABSTRACT

A weaving machine contains a reed (8) and a weft thread guide apparatus (32) which are connected to one another and are pivotal between an insertion position and a beat-up position. For the insertion of a weft thread, a weft insertion apparatus (14) which is arranged in a fixed spatial position and has at least one blower nozzle (22) for the insertion of a weft thread (38) into the guide passage (36), a thread clamp (16) and a shear (15) are provided. Coupled to the reed are the thread clamp in order to clamp an inserted weft thread (38) and to forward it synchronously with the guide passage (36) from the insertion point up to the abutment point, and the shear (15), with the shear (15) being placed after the thread clamp (16) in the beat-up direction in order to sever off the weft thread immediately after the clamping. Through the arrangement of the insertion apparatus in a fixed position and the functional association of the thread clamp and the shear with the reed, the control is simplified so that up to sixteen weft threads of differing kinds and colors can be inserted.

13 Claims, 8 Drawing Sheets

MECHANICAL LOOM WITH PNEUMATIC WEFT THREAD INSERTION WITH SYNCHRONIZED CLAMP CUTTER AND REED

BACKGROUND OF THE INVENTION

1. Field of the Invention

The invention relates to a weaving machine with pneumatic weft thread insertion.

2. Description of the Prior Art

Weaving machines with pneumatic weft thread insertion are known from the prior art, with the weft thread insertion being carried out either by means of a pivotal insertion apparatus which is mounted on the reed or by means of an insertion apparatus which is mounted in a fixed location on the machine frame.

The weaving machines with pivotal insertion apparatuses have disadvantages. The respectively inserted weft thread is clamped and severed in the region of the reed beat-up, so that the introduction of the blower nozzles into the insertion position can only take place during the withdrawal of the reed, which in particular limits the number of blower nozzles and in addition makes a special control system necessary. Relatively large inertial forces, which lead to undesirable oscillations of the moved system, are produced through the back and forth movement of the reed provided with the insertion apparatuses, and the weft threads are set into uncontrolled oscillation during their passage from the thread feeder into the blower nozzles so that they cross and entangle with one another. The air lines and the actuation apparatus are subject to too great a mechanical stress, which makes a complicated and expensive control system necessary in particular for the actuation apparatus. Lower speeds of rotation of the weaving machine, which is associated with a loss in productivity, result from these disadvantages as a result of a higher likelihood of breakdown. Furthermore, it proves disadvantageous that the thread clamp and the shear are also mounted on the machine frame and are actuated via separate drive means, which results in increased complication and expense.

The object of the invention is to improve a weaving machine with pneumatic weft thread insertion in such a manner that the named disadvantages do not arise.

SUMMARY OF THE INVENTION

The object is satisfied in accordance with the invention by a weaving machine with pneumatic weft thread insertion, with the weaving machine having a reed and a weft thread guide apparatus which are connected to one another and are pivotal between an insertion position and a beat-up position, and a weft insertion apparatus which is arranged in a fixed spatial position and has at least one blower nozzle for the insertion of a weft thread into the guide passage, a thread clamp and a shear, with the thread clamp being coupled to the reed in order to clamp an inserted weft thread and to forward it synchronously with the guide passage from the insertion location up to the beat-up position, and with the shear being placed after the thread clamp in the beat-up direction of the reed in order to sever off the weft thread after the clamping.

The advantage that can be achieved with the invention is essentially to be seen in the fact that up to sixteen weft threads of differing kinds and colors can be used.

The invention will be explained in the following with reference to the accompanying drawings.

DETAILED DESCRIPTION OF THE PREFERRED EMBODIMENT

Figure 1:
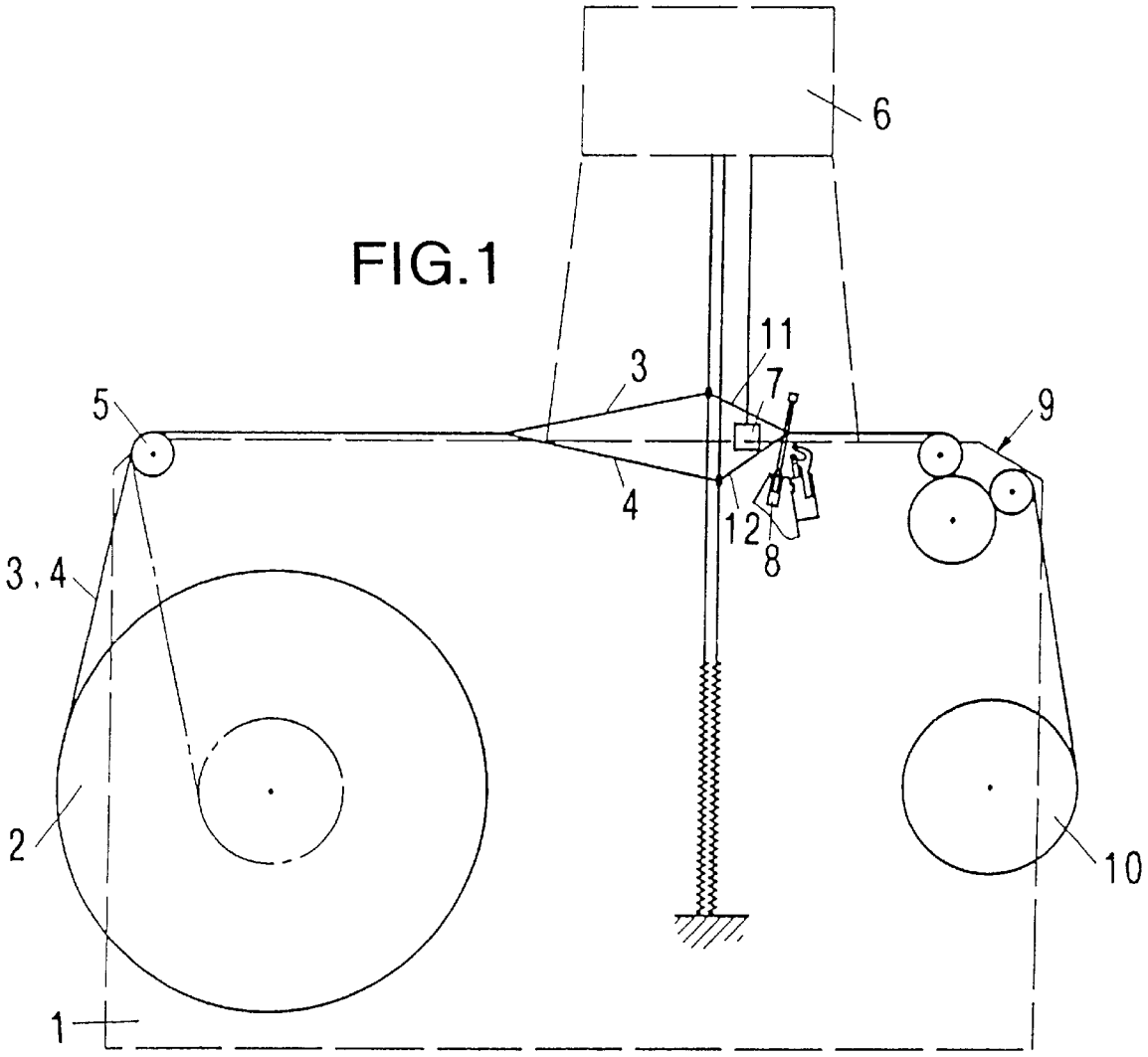
FIG. 1 a schematic view of an embodiment of a weaving machine with pneumatic insertion in accordance with the invention, FIG. 2 a side view of the weft insertion region of the weaving machine, illustrated in section, FIG. 3 a section along the line III—III in FIG. 2, FIG. 4 a section along the line IV—IV in FIG. 2, FIG. 5 a section along the line V—V in FIG. 2, FIG. 6 a section along the line VI—VI in FIG. 2, FIG. 7 a section along the line VII—VII in FIG. 2, FIG. 8 an embodiment of a control apparatus for the blower nozzles, FIG. 9 a section along the line X—X in FIG. 2 which illustrates the situation during the weft thread insertion, FIG. 10 the section of FIG. 9 which illustrates the situation during the clamping of the weft thread, FIG. 11 the section of FIG. 9 which illustrates the situation during the cutting of the weft thread and FIG. 12 the section of FIG. 9 which illustrates the situation during the beating up by the reed.

The weaving machine under discussion here contains a machine frame 1, a warp beam 2 from which warp threads 3, 4 are let off, a whip roll 5, a shed forming apparatus 6, an arrangement 7 for the insertion of weft threads, a reed 8, a fabric take-off 9 and a cloth beam 10. The shed forming apparatus 6 forms an upper and a lower shed 11, 12 with the warp threads 3, 4 via weaving heddles.

Figure 2:
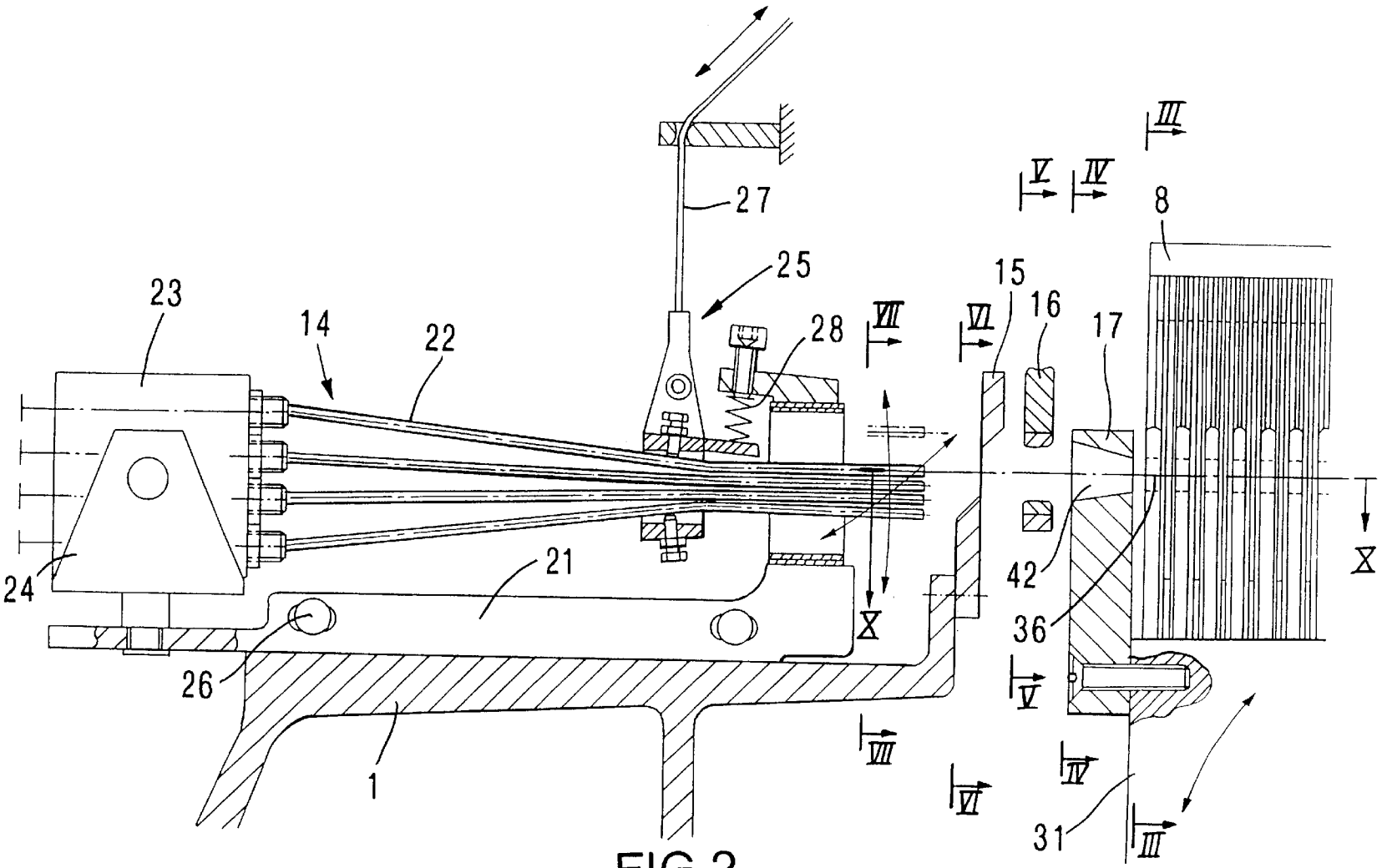

As shown in FIG. 2, the arrangement 7 contains a pneumatic weft thread insertion apparatus 14 and a shear 15, a thread clamp 16 and a blow-in aid 17, which are arranged in the direction of travel of the thread between the insertion apparatus 14 and the reed 8. The insertion apparatus 14 is mounted on the machine frame 1. The shear 15 and the thread clamp 16 are coupled to the reed 8. The blow-in aid 17 is connected to the reed 8.

The insertion apparatus 14 contains a support part 21, eight blower nozzles 22, a nozzle block 23, a holder 24 and an actuation apparatus 25. The support part 21 is fastened to the machine frame 1 by means of screws 26. The blower nozzles 22 are arranged pairwise and are in active contact with a source of compressed air and with a weft thread storage. The blower nozzles 22 are mounted in the nozzle block 23 so as to be releasable at one end. The holder 24 for the nozzle block is connected to the support part 21. The actuation apparatus 25 is connected to the shed forming apparatus 6 via a kinematic member 27 in order to place the blower nozzles 22 into the insertion position. For this, the nozzle block 23 and the holder 24 are executed in such a manner that the opening of the blower nozzles are pivotal about directions extending at right angles to one another. A spring 28 is provided which holds the kinematic member 27 under tension. It is pointed out that in place of the actuation apparatus 25 a drive arrangement can be provided which is controlled by a control system which is known per se in order to place the blower nozzles into the insertion position.

Figure 3:
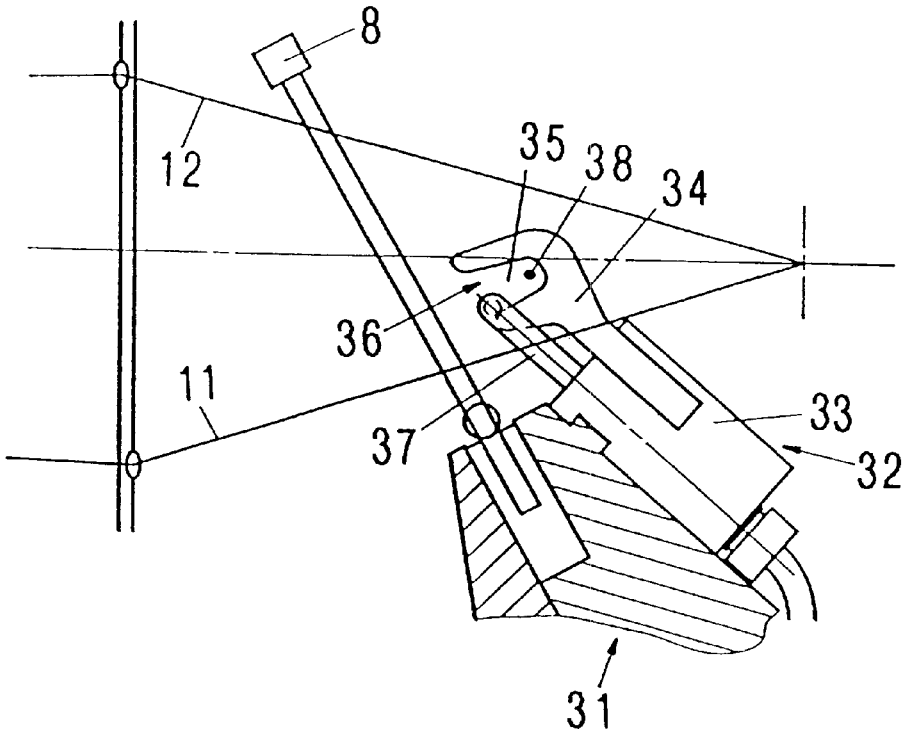

As shown in FIG. 3, the reed 8 is mounted on a reed strip 31. A thread guide apparatus 32 is fastened to the reed strip. It is advantageous if the guide apparatus 32 contains an air supply part 33 which is mounted on the reed strip, a plurality of lamella 34 which are arranged in comb-like manner and are each provided with a cut-out 35 in order to define a guide passage 36, and relay nozzles 37 in order to forward the inserted weft thread 38 through the guide passage. In place of the thread guide apparatus 32 a so-called tunnel reed with relay nozzles can be used.

Figure 4:
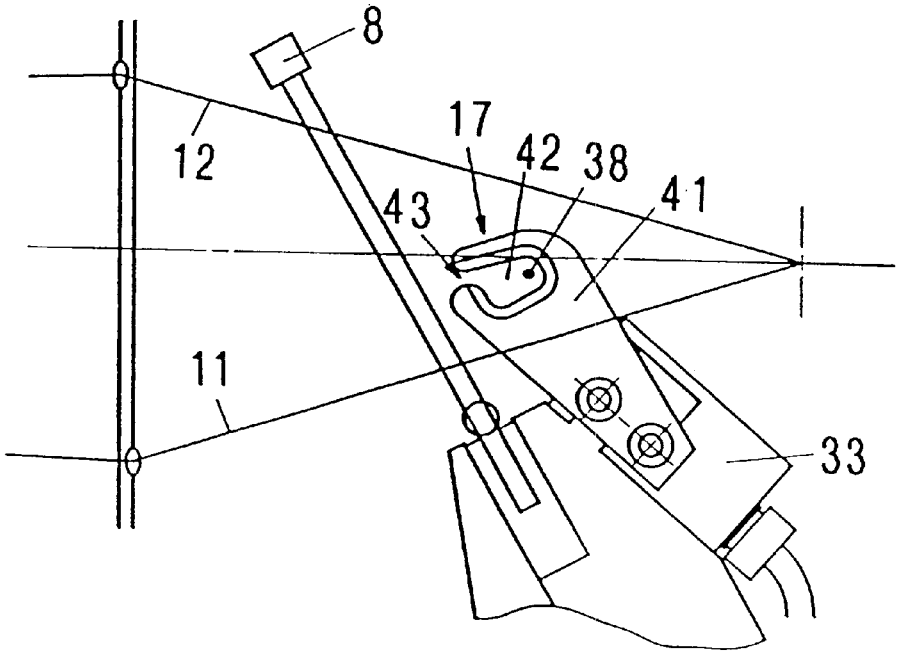

The blow-in aid 17 is advantageously used in the weaving machine under discussion here. The blow-in aid is a plate-like body 41 with a conical penetration 42 and with an outlet slit 43. The body 41 is fastened to the air guide part 33. It is however possible to execute the first lamella 34 as a blow-in aid (FIG. 4).

Figure 5:
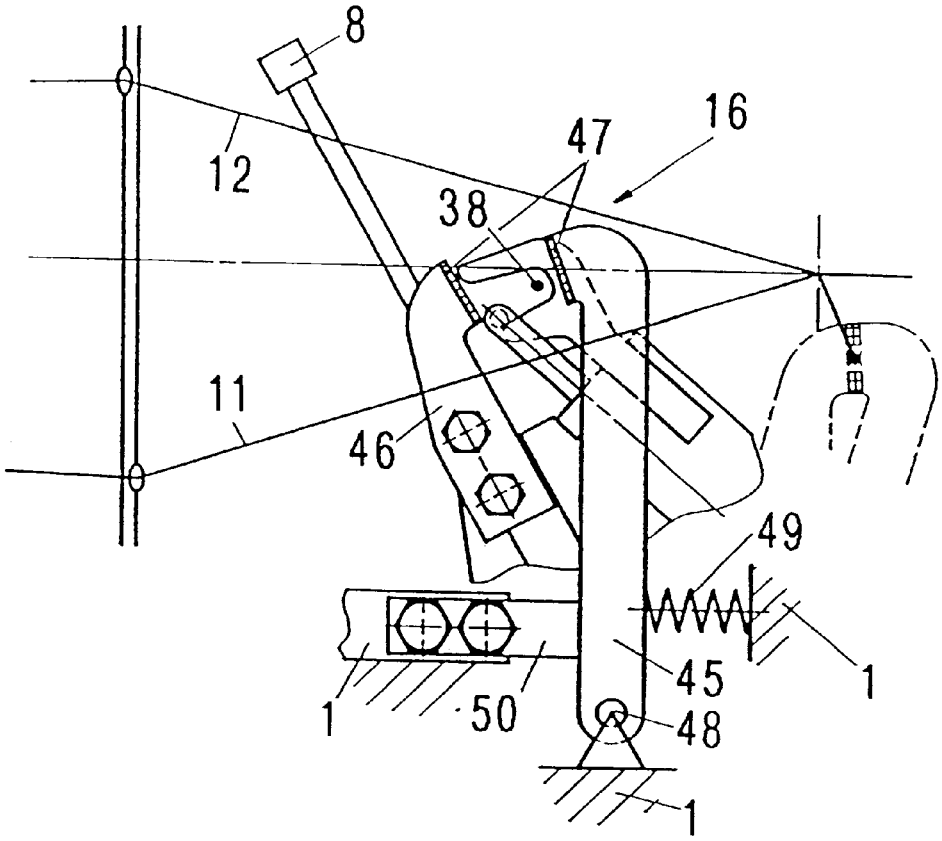

The thread clamp 16 has a clamping finger 45 and a clamping jaw 46 which are each provided with a plate 47 for holding the weft thread. The clamping finger is pivotally connected to an axle 48 which is arranged on the machine frame 1. The clamping jaw 46 is directly connected to the reed 7 and/or to the sley. Furthermore, a restoring spring 49 is provided for the clamping finger and contacts the machine frame 1 at the one end and the clamping finger at the other end. An abutment part 50 is mounted on the machine frame 1 in order to determine the position of the clamping finger (FIG. 5).

Figure 6:
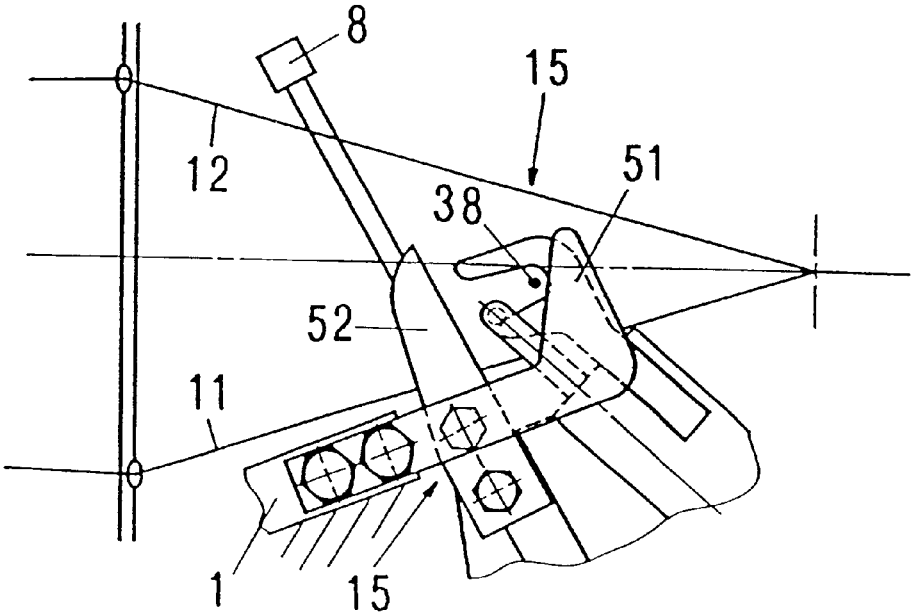

The shear 15 has a spatially fixed shearing blade and a movable shearing blade 51, 52. The spatially fixed shearing blade 51 is fastened to the machine frame 1. The movable shearing blade 52 is mounted on the reed 8 (FIG. 6).

Figure 7:
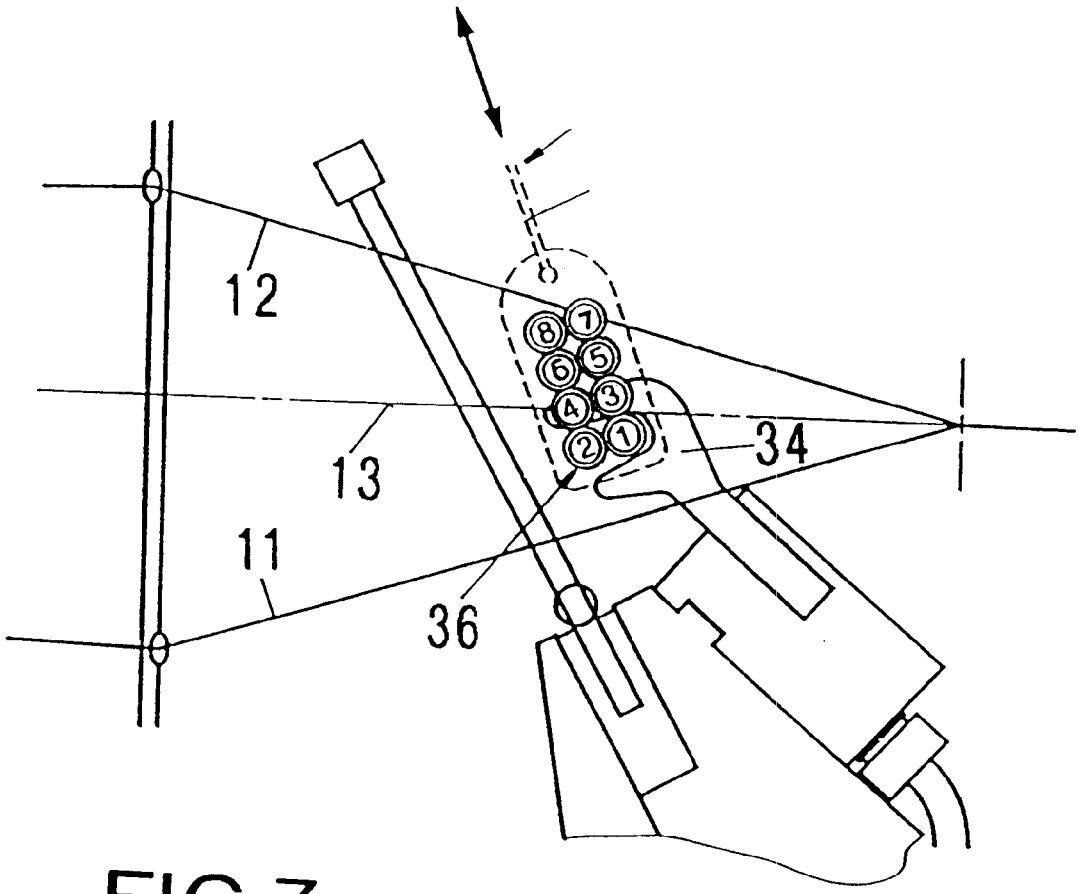

FIG. 7 shows the association of the blower nozzles with the guide passage 36 determined by the lamella 34. An essential feature of the weaving machine consists in the fact that the respective pair of blower nozzles is arranged substantially parallel to the centerline of the guide passage 36 when the guide passage takes on the insertion position. The setting of the blower nozzles 22 is done by the actuation apparatus 25 and the kinematic member 27. As an alternative to this, the blower nozzles 12 can be arranged in the form of a bundle.

Figure 8:
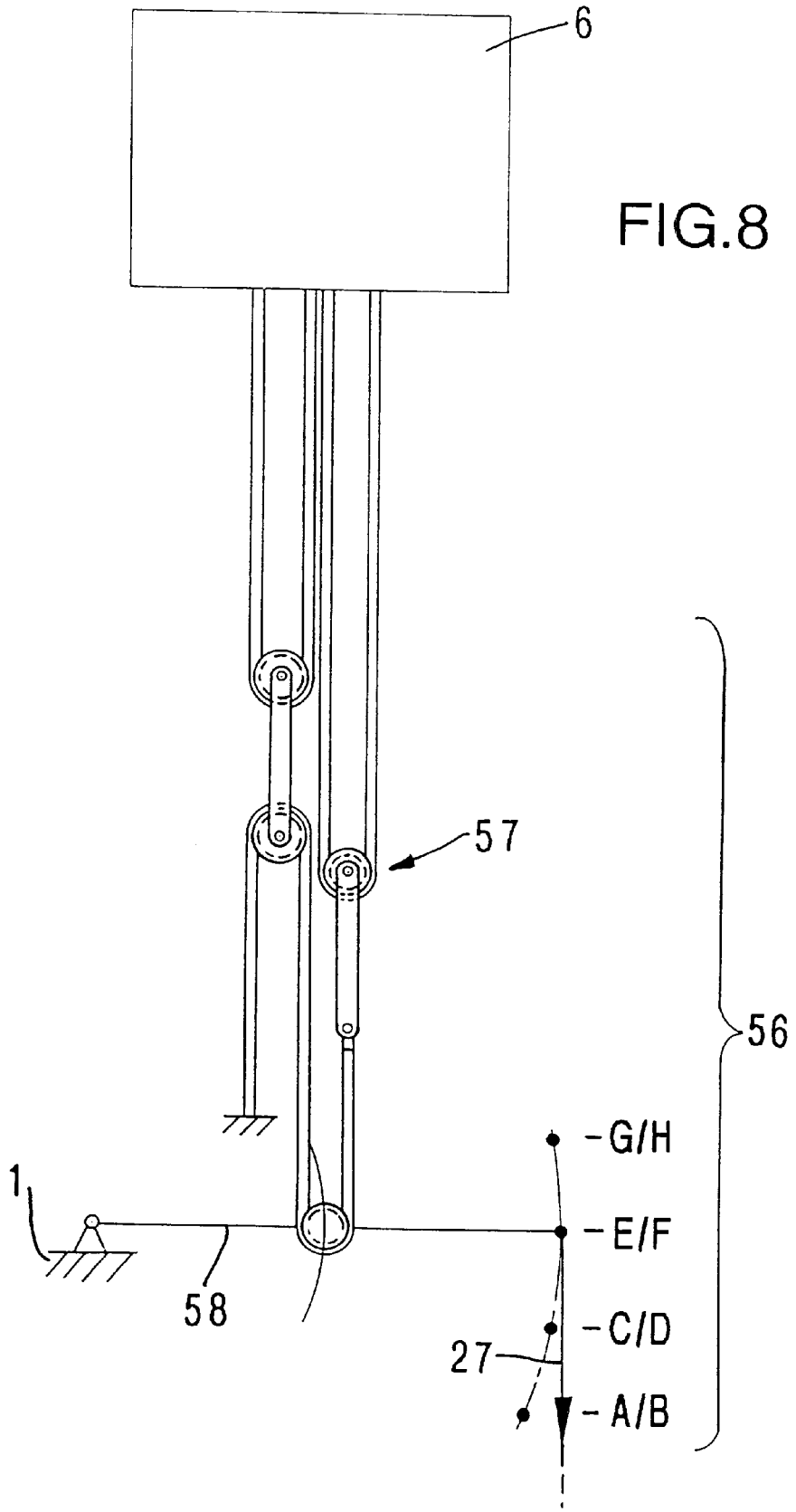

As FIG. 8 shows, the shed forming apparatus 6 comprises e.g. a Jacquard device or a dobby, a color control apparatus 56, a summation transmission 57 and a one-armed lever 58, which is pivotally connected to the machine frame 1. Summation transmissions of this kind and their functioning are known so that a description of same will be dispensed with. The kinematic member 27, which is connected to the actuation apparatus 25, is fastened to the lever 58.

The insertion process will be described in the following with reference to FIGS. 9 to 12. In weaving machines one weft thread is inserted and beat up per rotation of the main drive shaft of the weaving machine. The control of the individual elements of the weaving machine is derived from this machine cycle. In the above described weaving machine the drive of the reed 8 is controlled in general and, in relation to the weft insertion, only the setting of the blower nozzle 22 to the insertion position and the insertion of the weft thread 38 are controlled in dependence on the angle of rotation of the main shaft, whereas the time point of the clamping and severing of the weft thread 38 is determined by the design or functional association of the shear and the thread clamp to the reed 8. This has in particular the advantage that the control system is simplified.

Figure 9:
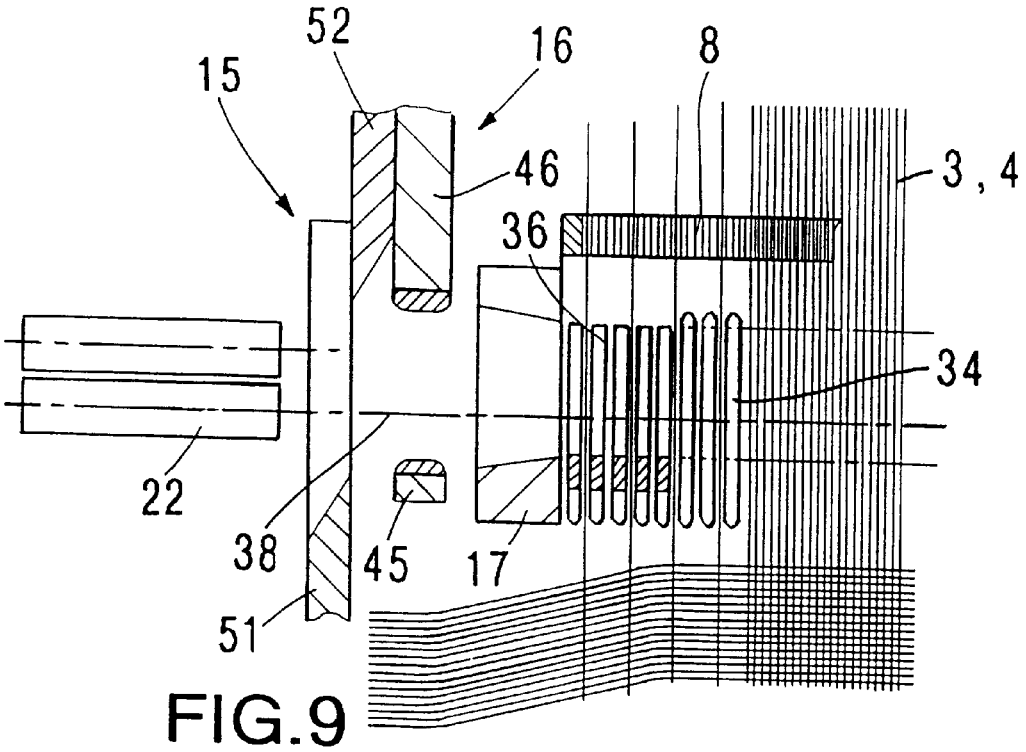

FIG. 9 shows the situation during the insertion of a weft thread 38. The blower nozzle 22 is placed into the insertion position. The reed 8 is in the drawn-back position; the shear 15 and the thread clamp 16 are in the opened position and the weft thread is shot into the guide passage 36 of the thread guide apparatus 32 by the blow-in aid 17.

Figure 10:
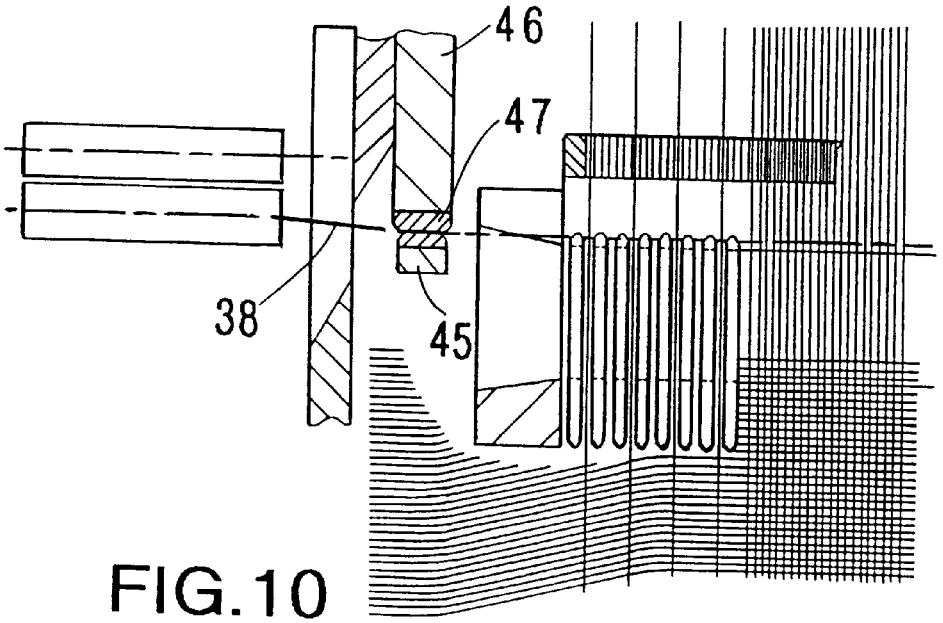

After the weft thread 38 has been inserted into the guide passage 36 the reed 8 is pivoted in accordance with the machine cycle in the direction towards the beat-up position and the inserted weft thread 38 is pushed forward by the reed 8. Because the clamping jaw 46 of the thread clamp 16 is connected to the reed 8 the clamping jaw 46 is pivoted towards the clamping finger 45 and the weft thread 38 is clamped in between the plates 47. The clamping finger 45 is consequently pivoted by the clamping jaw 46 against the force of the spring 49, with the weft thread 38 being held (FIG. 10).

Figure 11:
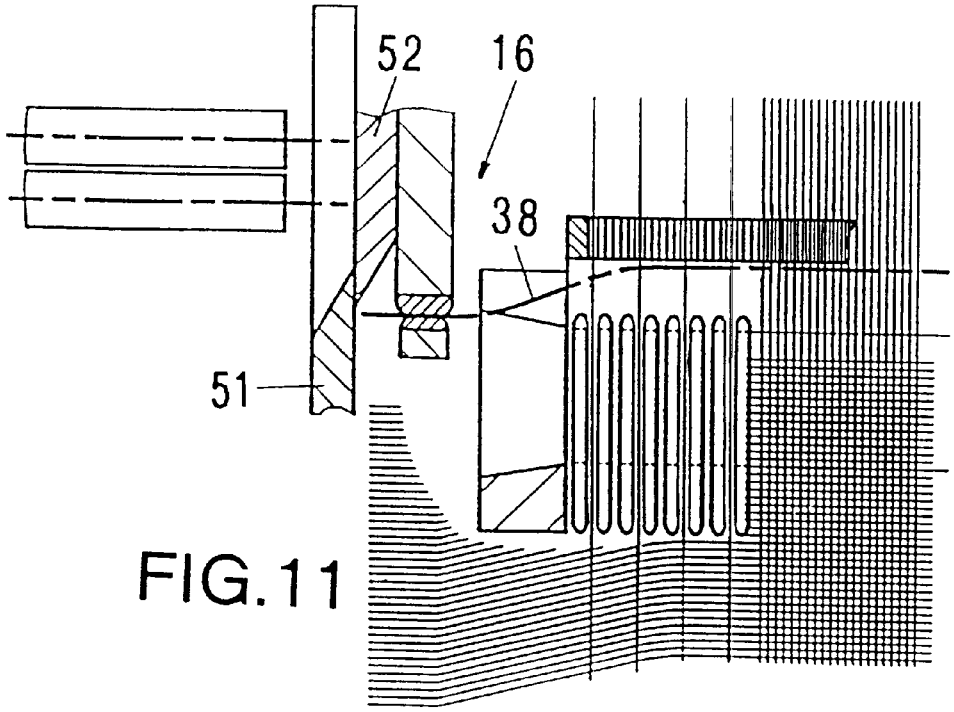

After the clamping the weft thread 38 is cut because the shear blade 52, which is connected to the reed 8, is moved against the spatially fixed shear blade 51. A new weft thread is thereby prepared for insertion. After the severing the weft thread 38 is moved synchronously with the reed 8 by the thread clamp 16 (FIG. 11).

Figure 12:
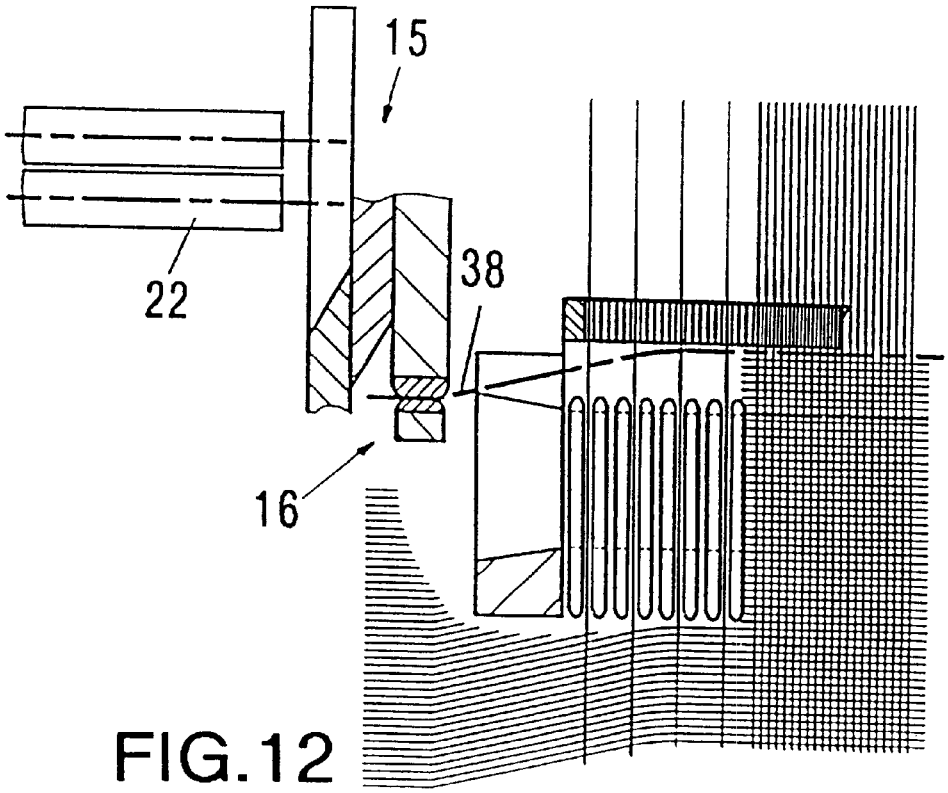

After this the reed 8 reaches the beat-up position, with the weft thread 38 being beat up by the reed 8 against the weft thread which had previously been beat up and already tied off by the change of the warp threads and is immediately thereafter drawn out or the thread clamp 16 (FIG. 12).

Thereafter the reed 8 is pivoted into the drawn-back position. With this pivoting movement the clamping jaw 46 is pivoted along with the reed. The clamping finger 45 follows the clamping jaw 46 as a result of the effect of the force of the spring 49 until it lies in contact with the abutment part 50. The clamping jaw 46 is moved further with the reed 8 and thus the thread clamp is opened for the subsequent weft thread insertion (FIG. 5).

In the above described weaving machine the weft thread 38 is thus inserted into the guide passage 36 by the spatially fixed waft insertion apparatus 14 and held, severed and beaten up during the pivoting of the reed 8. A series of advantages results from this. Through the spatially fixed insertion apparatus the supply of the weft thread from a weft thread feeder becomes more reliable and the time span for the setting of the blower nozzle into the insertion position is considerably extended so that up to sixteen weft threads of differing colours and kinds are inserted. Through the holding and the synchronous movement of the inserted waft thread with the reed up to the beating up, a problem-free beating up of the weft thread is ensured, with the protruding weft thread end sections being short and little refuse arising.

I claim:

1. Weaving machine with pneumatic weft thread insertion, the weaving machine comprising a reed (8) and a weft thread guide apparatus (32) which are connected to one another and are pivotal between an insertion position and a beat-up position, and a weft insertion apparatus (14) which is arranged in a fixed spatial position and has at least one blower nozzle (22) for insertion of a weft thread (38) into a guide passage (36), a thread clamp (16) and a shear (15), with the thread clamp being coupled to the reed in order to clamp an inserted weft thread (38) and to forward it synchronously with the guide passage (36) from an insertion location up to the beat-up position, and with the shear (15) being placed after the thread clamp (16) in a beat-up direction of the reed in order to sever off the weft thread after clamping.

2. Weaving machine in accordance with claim 1, with the shear (15), the thread clamp (16) and a blow-in guide part (17) being arranged one after the other in the direction or travel or the thread on the insertion side between the opening of the blower nozzle (22) and the guide passage (36).

3. Weaving machine in accordance with claim 2, with the blow-in guide part (17) being arranged in a fixed position or being connected to the reed (8).

4. Weaving machine in accordance with claim 3, with the blow-in guide part (17) having a conical penetration (42) which is turned with the largest width towards the opening of the blower nozzle (22) and an outlet slit (43) for the weft thread (38).

5. Weaving machine in accordance with claim 1 or claim 2, with the insertion apparatus (14) being mounted on the machine frame (1).

6. Weaving machine in accordance with one of the claim 1 with an actuation apparatus (25) being provided in order to place the blower nozzle (22) into the insertion position in accordance with a weaving pattern program.

7. Weaving machine in accordance with claim 1, with the insertion apparatus (14) having a plurality of blower nozzles (22).

8. Weaving machine in accordance with claim 7, comprising means for effecting at least one of moving the blower nozzles (22) upwardly and downwardly and pivoting the blowing nozzles (22) about axes crossing at right angles.

9. Weaving machine in accordance with claim 8, with the blower nozzles (22) being arranged pairwise and disposed one above the other or in the form of a bundle.

10. Weaving machine in accordance with claim 1 or claim 2, characterised in that the thread clamp (16) has a clamping finger (45) which is pivotal and has a clasping jaw (46) with is connected to the reed (8).

11. Weaving machine in accordance with claim 10 characterised in that the clamping finger (45) is a body which is pivotal about an axis (48) of fixed position or is an element pivotal about a bending axis.

12. Weaving machine in accordance with claim 10 characterized by a setting spring in order to place the clamping finger into the weft insertion position and in order to produce the holding force for the weft thread during the pivoting; and by an abutment part (50) in order to hold the clamping finger in the weft insertion position.

13. Weaving machine in accordance with claim 1 or claim 2, with the shear (15) having a blade (51) which is arranged at a fixed position and a movable blade (52); and with the movable blade being coupled to the reed or to a drive apparatus.

* * * * *